US005421383A

United States Patent [19]

Schmid

[11] Patent Number: 5,421,383

[45] Date of Patent: Jun. 6, 1995

[54] SLIDE RAIL SYSTEM FOR AERATION DIFFUSERS AND MIXERS

[76] Inventor: Lawrence A. Schmid, 3107 Harahay Ridge, Manhattan, Kans. 66502

[21] Appl. No.: 113,747

[22] Filed: Aug. 31, 1993

[51] Int. Cl.[6] ..... B65B 3/04

[52] U.S. Cl. ..... 141/232; 141/89; 141/236; 141/383; 141/387; 137/592; 285/61; 248/70; 248/79; 4/490

[58] Field of Search ..... 141/67, 85, 89, 90, 141/231-236, 383, 386, 387; 137/590, 592; 248/49, 65, 70, 79; 285/61; 4/490, 492, 541.1, 507, 567-570, 605, 615, 612; 134/104.1

[56] References Cited

U.S. PATENT DOCUMENTS

| | | | |
|---|---|---|---|
| 1,111,692 | 9/1914 | Harvey et al. | 4/569 |
| 1,188,681 | 6/1916 | Rosenberg | 4/567 |
| 1,189,970 | 7/1916 | Kline | 248/79 |
| 1,501,762 | 7/1924 | Ferguson | 4/569 X |
| 3,971,074 | 7/1976 | Yxfeldt | 4/570 |
| 4,207,932 | 6/1980 | Gilmour | 141/90 |
| 4,215,444 | 8/1980 | Brown | 4/612 |
| 4,224,700 | 9/1980 | Bloys | 4/603 |
| 4,741,289 | 5/1988 | Blose | 4/567 X |
| 4,754,504 | 7/1988 | Cellini | 4/605 X |
| 4,970,734 | 11/1990 | Friedman et al. | 4/612 X |
| 5,077,842 | 1/1992 | Horne, Jr. | 4/568 |

FOREIGN PATENT DOCUMENTS

| | | | |
|---|---|---|---|
| 0038698 | 4/1928 | Denmark | 4/603 |
| 1073127 | 9/1954 | France | 4/603 |
| 2644813 | 9/1990 | France | 4/570 |

*Primary Examiner*—J. Casimer Jacyna
*Attorney, Agent, or Firm*—Hovey, Williams, Timmons & Collins

[57] ABSTRACT

A light weight apparatus for introducing a gas or liquid from a supply source into an open-topped liquid treatment tank includes an elongated support rail mounted in the tank, and a fluid delivery pipe assembly having at least one nozzle at the bottom end thereof, and a union at the top end thereof for connecting the pipe assembly with the fluid supply source. The pipe assembly is supported on the rail by spacers when the assembly is in a lowered position in which the at least one nozzle is disposed within the tank and the top end of the pipe assembly is aligned with the union. The spacers allow the pipe assembly to be axially translated along the rail, when the pipe assembly is disconnected from the supply source, between the lowered position and a raised position in which the at least one nozzle is removed from the tank for cleaning or repair.

12 Claims, 2 Drawing Sheets

SLIDE RAIL SYSTEM FOR AERATION DIFFUSERS AND MIXERS

BACKGROUND OF THE INVENTION

1. Field of the Invention

The present invention relates generally to liquid treatment devices and, more particularly, to a lightweight apparatus for introducing a gas or liquid from a fluid supply source into an open topped treatment tank.

2. Discussion of the Prior Art

There is a requirement in many different types of liquid treatment processes that air or other gases such as chlorine or sulfur dioxide be injected into the liquid. For example, during mixing of chemical compositions, aeration of sewage water, or aeration of water used for aquaculture, it is commonly necessary to blow air into the mixing or treatment tanks by introducing air through nozzles, e.g. diffusers.

Likewise, where other gases or liquids are to be introduced into a liquid, it is known to inject these additives by delivering the additives through suitable nozzles such as injectors or diffusers in order to provide the desired treatment.

It is conventional to employ rigid piping in an open topped liquid treatment tank for delivering a treatment fluid to the tank. When maintenance of such piping is required, the entire tank is drained and cleaned before maintenance is conducted on the nozzles of the diffuser or injector assemblies that are secured at the bottom of the rigid piping within the tank. Thus, the treatment process must be shut down entirely or moved to a different tank in order for such maintenance to be completed.

Numerous hazards and drawbacks are presented by this conventional construction. For example, because the nozzles are located at the bottom of what are often deep tanks, the workers are placed in a hazardous environment in which they must climb into and out of the tank to conduct repairs and because of the nature of many known liquid treatment processes, the workers are exposed to hazardous materials once the tank is emptied. In addition, the entire process of draining and cleaning the tank, and of repairing the nozzles may require weeks, at a substantial cost to the treatment operator.

An attempted solution to the problems presented by the permanent piping construction is to provide the injectors on a large arm fastened to the top of a tank. By forming the arm as a knuckle boom, and by installing winches to operate the booms, it is possible to pull the nozzles from the tank for servicing. However, this construction is large, heavy, expensive, and difficult for a single operator to handle.

OBJECTS AND SUMMARY OF THE INVENTION

It is an object of the present invention to provide a lightweight fluid delivery assembly that can be inserted into or removed from an open topped liquid treatment tank, and that is capable of being handled by a single person.

It is another object of the invention to provide a lightweight fluid delivery assembly that is rigidly supported within the tank during use, but which may be easily loosened and removed from the tank to expose the complete assembly for cleaning and/or repair.

In accordance with these and other objects evident from the following description of a preferred embodiment of the invention, an apparatus is provided for introducing fluid from a fluid supply source into an open-topped liquid treatment tank.

The apparatus comprises an elongated support rail, a mounting means for mounting the support rail in the tank, and a fluid delivery pipe assembly presenting a bottom end and a top end. The pipe assembly includes at least one nozzle at the bottom end thereof and a connection means at the top end thereof for connecting the pipe assembly with the fluid supply source and for selectively disconnecting the assembly from the source. A spacer means is provided on the assembly for supporting the assembly on the rail in a lowered position in which the at least one nozzle is disposed within the tank and the top end of the pipe assembly is aligned with the connection means. However, the spacer means allows the pipe assembly to be axially translated along the rail, when the pipe assembly is disconnected from the supply source, between the lowered position and a raised position in which the at least one nozzle is removed from the tank.

By providing this construction, numerous advantages are achieved. For example, by providing a support rail that is mounted in the tank, and by supporting the pipe assembly on the rail, it is possible to employ a pipe assembly constructed of lightweight materials which, when standing alone, lack the necessary rigidity to stand up to normal use within a treatment tank. Further, by allowing the assembly to be translated along the rail between the lowered, use position and a raised, exposed position, it is possible to provide an assembly which is easily removed from the tank to permit cleaning and/or repair of one or more nozzles normally supported adjacent the bottom of the tank.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 1:
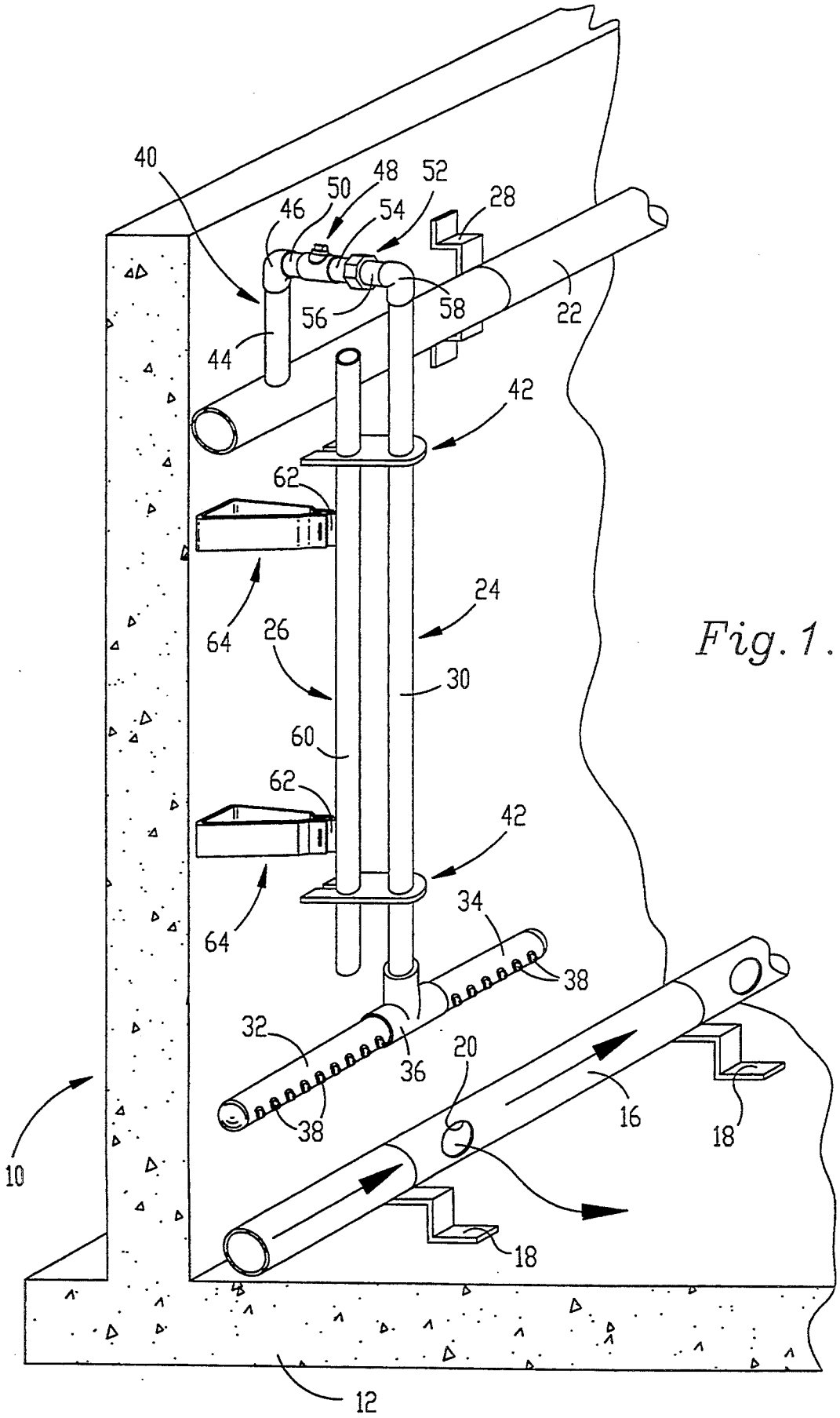
FIG. 1 is a perspective view of an open topped liquid treatment tank and a fluid introduction apparatus constructed in accordance with the preferred embodiment.

An open topped liquid treatment tank and associated fluid introduction apparatus constructed in accordance with the preferred embodiment are illustrated in FIG. 1.

The tank 10 is formed of concrete or any other suitable material, and includes a bottom wall 12 and a side wall 14 extending vertically upward from the bottom wall. The tank may be round, rectangular or any other desirable shape, and may be provided with an inlet pipe 16 through which water or other liquid to be treated is introduced into the tank. For example, as shown in FIG. 1, a horizontally extending inlet pipe 16 is mounted to the bottom wall of the tank by a plurality of brackets 18, and includes several openings 20 facing the interior of the tank.

The fluid introduction apparatus generally includes a fluid supply source 22, a fluid delivery pipe assembly 24 connected to the source, and support structure 26 for supporting the pipe assembly within the tank.

The fluid supply source is formed of a large supply pipe 22 to which the fluid to be introduced into the tank is delivered. This pipe 22 may be formed of polyvinylchloride (PVC) or any other suitable material, and is mounted on the side wall of the tank by brackets 28.

The fluid delivery pipe assembly 24 includes a vertical pipe section 30 having upper and lower ends, a pair of horizontally extending sections 32, 34 connected to the lower end of the vertical section 30 by a T-shaped fitting 36, a plurality of nozzles 38 provided on the horizontally extending sections, a connection means 40 at the upper end of the vertical pipe section 30 for connecting the pipe assembly with the supply pipe 22 and for selectively disconnecting the assembly from the supply pipe, and a spacer means 42 for supporting the pipe assembly on the support structure 26 in a lowered position, as shown in FIG. 1, in which the nozzles 38 are disposed within the tank and the upper end of the vertical pipe section 30 is aligned with the connection means 40.

The vertical and horizontal sections 30, 32, 34 of the pipe assembly, as well as the T-fitting 36 and at least some or all of the components of the connection means 40 are formed of PVC, which is a lightweight material presenting an assembly that may be handled by a single person. It is noted that other such materials may be used which provide a lightweight assembly capable of being lifted manually from the tank and presenting a noncorrosive surface to the contents of the tank and to the fluid being introduced.

The nozzles 38 are of conventional construction, and may be either injectors, diffusers, or any other type of known nozzle which may be used to introduce gases and/or liquids into the tank. The term "nozzle" is used herein to describe any such opening in the delivery pipe assembly.

Figure 2:
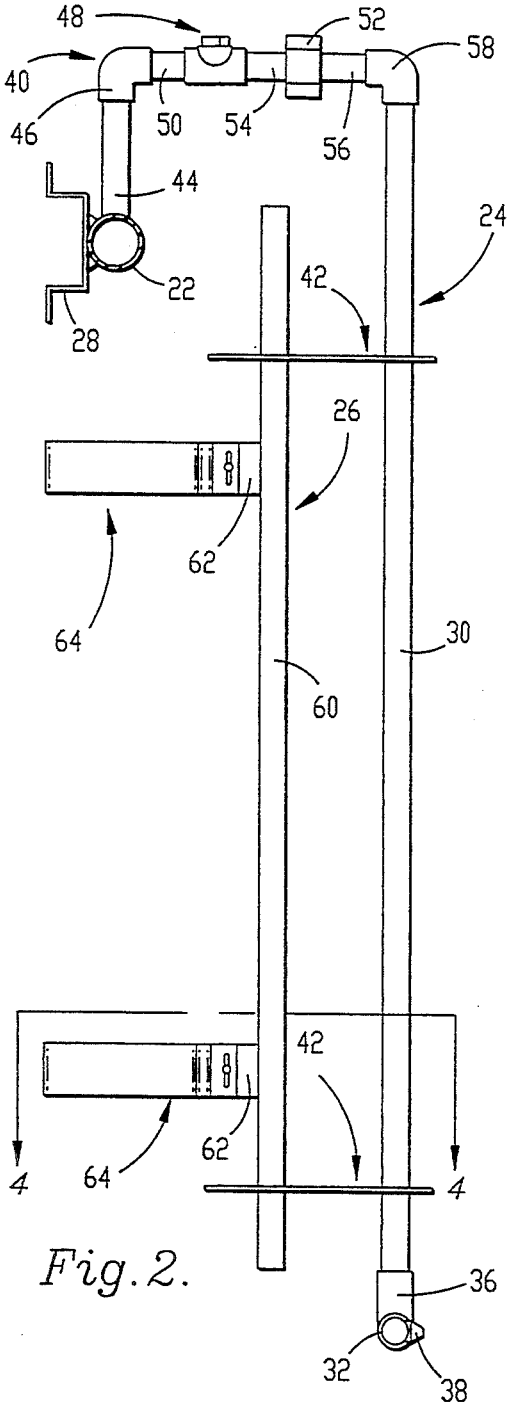
FIG. 2 is a side elevational view of the apparatus.

The connection means 40 is illustrated in FIG. 2 and includes a short vertical pipe section 44 connected to the supply pipe 22, a 90° elbow 46 connected to the vertical section 44, a valve 48 connected to the elbow by a short pipe section 50 and defining a means for controlling flow between the supply pipe 21 and the delivery pipe assembly 24, and a threaded union 52 including threaded male and female members connected between the valve and the delivery pipe assembly by a short pipe section 54, a short pipe section 56 and a 90° elbow 58.

The valve 48 is of conventional construction, and may be either manually or automatically operated to either open or close the valve, or to throttle fluid flow to the assembly.

The union 52 is also conventional, and when the male and female threaded members are fastened together they form an air-tight passage between the supply pipe 22 and the assembly 24. Thus, the union is movable between a coupled position in which the sections are in fluid communication with each other and the vertical pipe section of the assembly communicates with the supply pipe 22, and a decoupled position in which the pipe assembly is completely physically detached from the supply pipe and free to move relative thereto.

The support structure 26 is shown in FIG. 2, and includes an elongated support rail 60, and a mounting means for mounting the support rail in the tank. The support rail 60 is preferably formed of a hollow stainless steel tube having a circular cross-sectional shape. However, other non-corrosive materials may be used, and it is possible to construct the rail of any desired shape presenting a surface against which the pipe assembly may be rigidly supported when positioned in the tank.

A pair of stainless steel ears 62 are welded or otherwise permanently affixed to the rail on a side of the rail opposite the pipe assembly and adjacent the side wall of the tank. These ears 62 are provided with holes through which the rail is connected to the mounting means.

Figure 4:
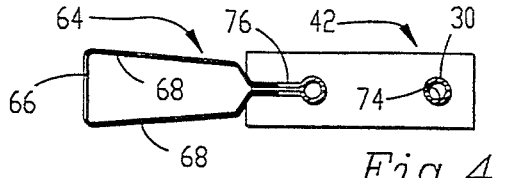
FIG. 4 is a sectional view of the apparatus taken along line 4—4 of FIG. 3.
Figure 3:
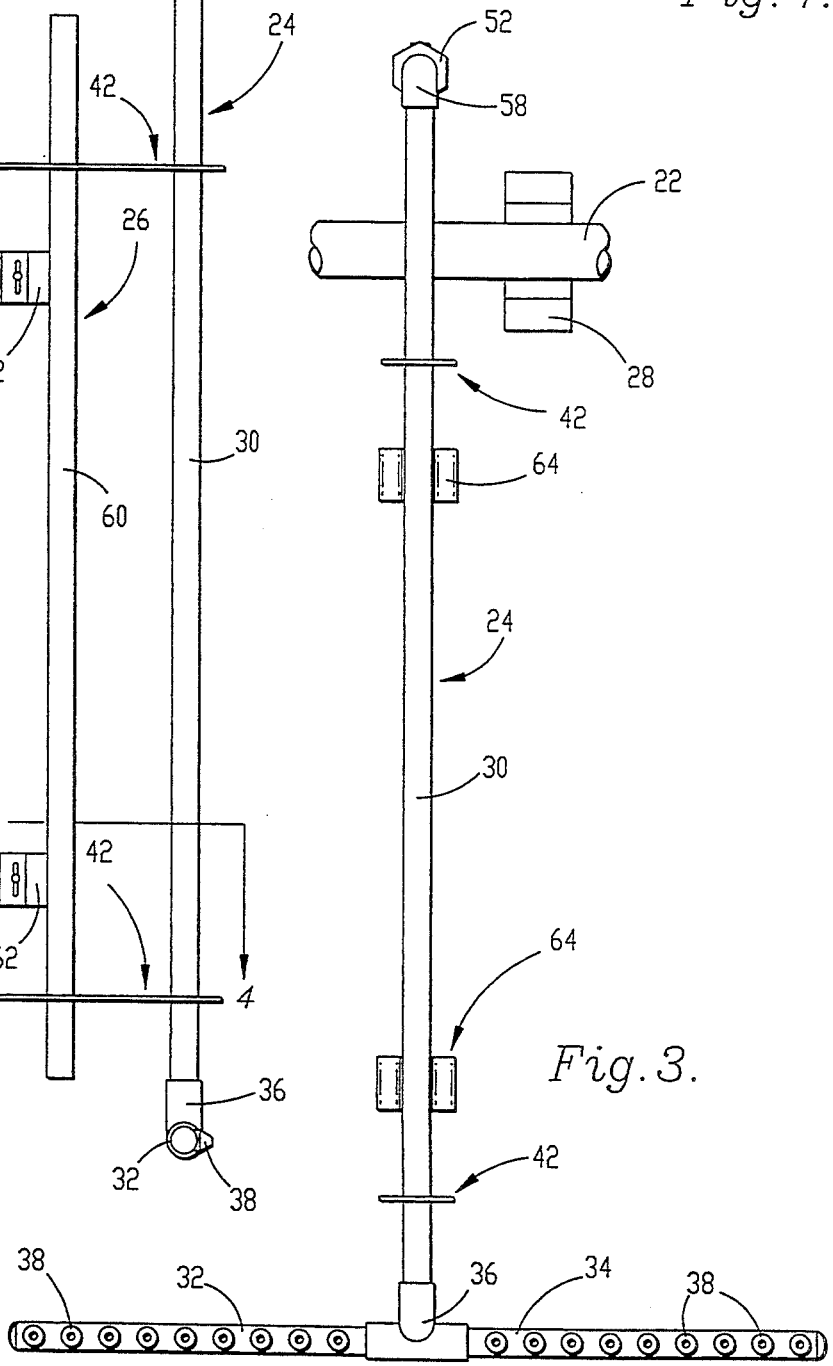
FIG. 3 is a front elevational view of the apparatus.

The mounting means includes a pair of vertically spaced brackets 64 which are fastened to the side wall of the tank. As shown in FIG. 4, the brackets are each provided with an end wall 66 and a pair of opposed sides 68 which converge toward one another to define a gap within which one of the ears 62 is received. A vertical slot 70 extends through the sides of each bracket so that a fastener, such as a stainless steel bolt 72 or the like, may be used to secure the rail to the brackets. The slots 70 enable the rail 60 to be vertically adjusted relative to the side wall of the tank before the fasteners 72 are tightened.

The spacer means 42 is also illustrated in FIG. 4, and includes at least two spacers which allow the pipe assembly 24 to be axially translated along the rail 60, when the pipe assembly is disconnected from the supply pipe 22, between the lowered position and a raised position in which the nozzles 38 are removed from the tank for inspection, cleaning and/or repair.

Preferably, each spacer 42 is formed of a sheet of any suitable conventional resinous material such as an ultra-high molecular weight resinous material which provides inherent lubrication during relative movement between the spacers and the rail 60 of the support structure. Each spacer 42 is generally rectangular, having a circular opening 74 formed adjacent one end, and a cutout 76 extending inward of the opposing end thereof. The cutout 76 is keyhole-shaped, having a rectangular section adapted to clear the sides of the brackets 64 when the assembly 24 is removed from the tank, and a circular section sized to receive the rail 60.

The spacers 42 are affixed to the vertical pipe section 30 and do not move relative to the pipe assembly during raising and lowering of the assembly. However, the spacers are free to slide along the rail over the brackets so that the assembly may be moved between the raised and lowered positions.

During installation, the location of one or more of the fluid introduction apparatuses within a tank is determined, and the brackets 64 associated with each apparatus are installed. Thereafter, the rails 60 are positioned relative to the brackets, and are fastened to the brackets so that the rails are rigidly supported in the tank.

Assuming the supply pipe 22 is already in place within the tank, the next step in assembling each apparatus includes installing the pipe sections 44, 50, 54, and 56, elbows 46, 58, valve 48 and union 52 on the supply pipe in alignment with the rail 60. Thereafter, the fluid delivery pipe assembly 24 is simply lowered onto the rail so that each spacer 42 fits onto and over the rail 60 and slides along the rail, guiding the assembly into the tank.

As the assembly reaches the lower position, with the nozzles disposed adjacent the bottom wall, the upper end of the vertical section 30 comes into alignment with the union member provided on the supply pipe, and the union is tightened to provide an airtight connection between the supply pipe and delivery pipe assembly.

Upon completion of the installation, the apparatuses may be operated individually by operating the valve 48 associated with each apparatus. Should the nozzles on one of the apparatuses require repair or the like, the valve associated with that apparatus is closed, the union 52 is loosened to decouple the pipe assembly from the supply pipe, and is manually raised out of the tank along the rail so that the maintenance person may conduct the repair outside of the tank.

During normal operation of the apparatuses, the pipe assemblies 24 are retained in position within the tank by the spacers 42 which support the assemblies on the rigid stainless steel rails 60. Thus, the lightweight pipe material chosen for the assemblies is reinforced during use to provide adequate physical integrity to withstand normal loads exerted on the apparatus during a mixing or aeration process.

Although the invention has been described with reference to the preferred embodiment illustrated in the attached drawing figures, it is noted that equivalents may be employed and substitutions made herein without departing from the scope of the invention as recited in the claims.

What is claimed is:

1. An apparatus for introducing fluid from a fluid supply source into an open-topped liquid treatment tank presenting bottom and side walls, the apparatus comprising:

an elongated support rail;

a mounting means for mounting the support rail vertically within the tank along the side wall; and a fluid delivery pipe assembly including a vertical pipe section presenting bottom and top ends, at least one nozzle at the bottom end of the pipe section, a connection means at the top end of the pipe section for selectively connecting and disconnecting the pipe assembly with the fluid supply source, and a spacer means for supporting the pipe assembly on the support rail in a lowered operative position in which at least one nozzle is disposed near the bottom of the tank and the top end of the pipe section is connected to the supply source, the spacer means including a pair of spacers separated from one another along the vertical pipe section and allowing relative movement between the pipe assembly and the support rail so that the pipe assembly may be axially lifted from the tank along the support rail when the pipe assembly is disconnected from the supply source.

2. An apparatus as recited in claim 1, further comprising a valve means connected between the fluid supply source and the pipe assembly for controlling flow from the source to the assembly.

3. An apparatus as recited in claim 1, wherein the mounting means includes a pair of spaced brackets secured to the rail, and a fastening means for fastening the brackets to the tank.

4. An apparatus as recited in claim 1, wherein the pipe assembly includes a T-shaped fitting connected to the lower end of the vertical section, and a pair of horizontal pipe sections connected to the fitting, and wherein at least one nozzle is provided on each of the horizontal sections.

5. An apparatus as recited in claim 4, wherein the spacer means includes a spacer attached to the vertical pipe section, the spacer having a cutout in which the rail is received when the pipe assembly is moved to the lower position so that the pipe assembly is supported on the rail.

6. An apparatus as recited in claim 4, wherein the pipe sections and the T-shaped fitting are formed of polyvinylchloride (PVC).

7. An apparatus as recited in claim 1, wherein the connection means includes a union between the top end of the pipe assembly and the fluid supply source, the union being movable between a connected position in which the pipe assembly is coupled to the source so that the source supports the pipe assembly by the union, and a disconnected position in which the pipe assembly is detached from the source so that the assembly may be lifted from the tank.

8. An apparatus as recited in claim 1, wherein the support rail is formed of a non-corrosive material.

9. An apparatus as recited in claim 1, wherein the support rail is formed of stainless steel.

10. An apparatus as recited in claim 1, wherein the at least one nozzle is a diffuser for diffusing a gas into the tank.

11. An apparatus as recited in claim 1, wherein the at least one nozzle is an injector for injecting a liquid into the tank.

12. An apparatus for introducing fluid from a fluid supply source into an open-topped liquid treatment tank presenting bottom and side walls, the apparatus comprising:

an elongated support rail;

a mounting means for mounting the support rail vertically within the tank along the side wall; and a fluid delivery pipe assembly including a vertical pipe section presenting bottom and top ends, at least one nozzle at the bottom end of the pipe section, a connection means at the top end of the pipe section for selectively connecting and disconnecting the pipe assembly with the fluid supply source, and a spacer means for supporting the pipe assembly on the support rail in a lowered operative position in which at least one nozzle is disposed near the bottom of the tank and the top end of the pipe section is connected to the supply source, the spacer means allowing relative movement between the pipe assembly and the support rail so that the pipe assembly may be axially lifted from the tank along the support rail when the pipe assembly is disconnected from the supply source, the pipe assembly including a T-shaped fitting connected to the bottom end of the vertical pipe section and a pair of horizontal pipe sections connected to the fitting, and wherein at least one nozzle is provided on each of the horizontal sections, the spacer means including a spacer attached to the vertical pipe section, the spacer having a cutout in which the rail is received when the pipe assembly is moved to the lower position so that the pipe assembly is supported on the rail, wherein at least two spacers are provided on the vertical pipe section, the spacers being separated from one another along the vertical pipe section.

* * * * *